US005975188A

United States Patent [19]

Lassow et al.

[11] Patent Number: 5,975,188

[45] Date of Patent: Nov. 2, 1999

[54] METHOD OF CASTING WITH IMPROVED DETECTABILITY OF SUBSURFACE INCLUSIONS

[75] Inventors: Eliot S. Lassow; George R. Strabel, both of N. Muskegon, Mich.; Kelly A. Koziol, Chesapeake, Va.

[73] Assignee: Howmet Research Corporation, Whitehall, Mich.

[21] Appl. No.: 08/960,995

[22] Filed: Oct. 30, 1997

[51] Int. Cl.[6] ..... B22D 46/00; B22C 1/02

[52] U.S. Cl. ..... 164/76.1; 164/517; 164/519; 164/4.1

[58] Field of Search ..... 164/76.1, 517, 164/518, 519, 4.1

[56] References Cited

U.S. PATENT DOCUMENTS

| | | | |
|---|---|---|---|
| 3,537,949 | 11/1970 | Brown et al. . | |
| 3,994,346 | 11/1976 | Brown | 164/361 |
| 4,065,544 | 12/1977 | Hamling et al. | 423/252 |
| 4,171,562 | 10/1979 | Freeman et al. | 29/530 |
| 4,703,806 | 11/1987 | Lassow et al. | 164/518 |
| 4,740,246 | 4/1988 | Feagin | 106/38.22 |
| 4,837,187 | 6/1989 | Frank et al. | 501/127 |
| 4,947,927 | 8/1990 | Horton | 164/517 |
| 4,966,225 | 10/1990 | Johnson et al. | 164/519 |
| 5,145,833 | 9/1992 | Prunier, Jr. et al. | 505/1 |
| 5,183,801 | 2/1993 | Virkar et al. | 501/152 |
| 5,221,336 | 6/1993 | Horton | 106/38.2 |
| 5,242,007 | 9/1993 | Remmers et al. | 164/4.1 |
| 5,407,001 | 4/1995 | Yasrebi et al. | 164/519 |
| 5,535,811 | 7/1996 | Feagin | 164/139 |

FOREIGN PATENT DOCUMENTS 237 907 A1 6/1985 German Dem. Rep. .

60-054266 3/1985 Japan .

OTHER PUBLICATIONS

Certificate of Analysis, Auercoat 4/3 Erbiumoxide fused.

Formation and Thermal Stability of an Oxide Dispersion in a Rapidly Solidified Ti–Er Alloy; Scripta Metallurgica, vol. 17 pp. 963–966, 1983.

The Interaction of Titanium With Refractory Oxides; Titanium Science and Technology, Plenum Press, 1973, pp. 271–284.

On the Evaluation of Stability of Rare Earth Oxides as Face Coats For Investment Casting of Titanium; Metallurgical Transactions B, vol. 21B, Jun. 1990, pp. 559–566.

*Primary Examiner*—Harold Pyon
*Assistant Examiner*—I.-H. Lin

[57] ABSTRACT

Method of making a casting by investment casting of a metal or alloy, especially titanium and its alloys, in a ceramic investment shell mold in a manner to provide enhanced x-ray detectability of any sub-surface ceramic inclusions that may be present below exterior surfaces of the casting. The method involves forming a ceramic mold facecoat and/or back-up layer including erbia or other x-ray or neutron-ray detectable ceramic component. The facecoat/back-up layer is/are formed using a ceramic slurry comprising erbia and other optional ceramic particulates, an inorganic binder, and an inorganic pH control agent. The slurry is applied to a pattern of component to be cast to form the mold. A metal or alloy is cast in the mold, and the solidified casting is removed from the mold. The casting is subjected to radiography to detect any sub-surface ceramic inclusions below the exterior surface thereof not detectable by visual inspection of the casting.

13 Claims, 4 Drawing Sheets

1. DEPTH OF FLAT BOTTOM HOLES: .005 IN. ⊗
2. DEPTH OF FLAT BOTTOM HOLES: .010 IN. ●
3. DEPTH OF FLAT BOTTOM HOLES: .020 IN ●

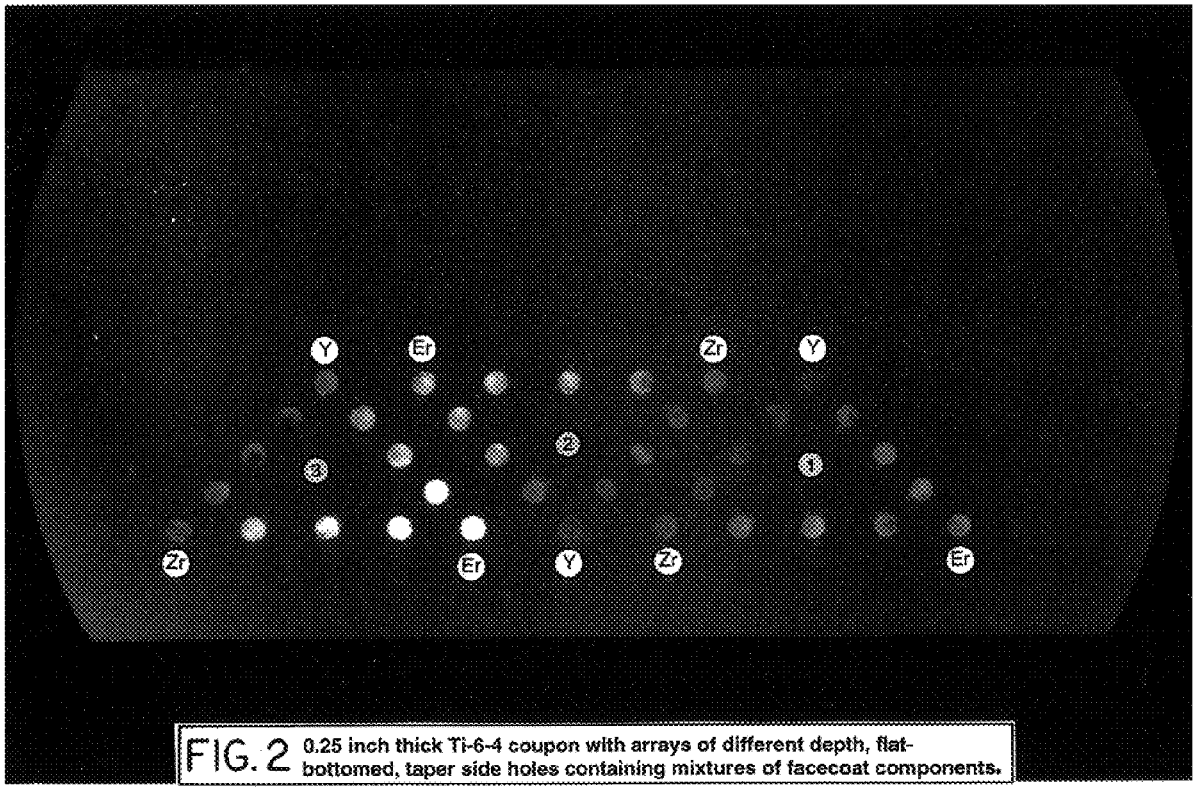
FIG. 2 0.25 inch thick Ti-6-4 coupon with arrays of different depth, flat-bottomed, taper side holes containing mixtures of facecoat components.

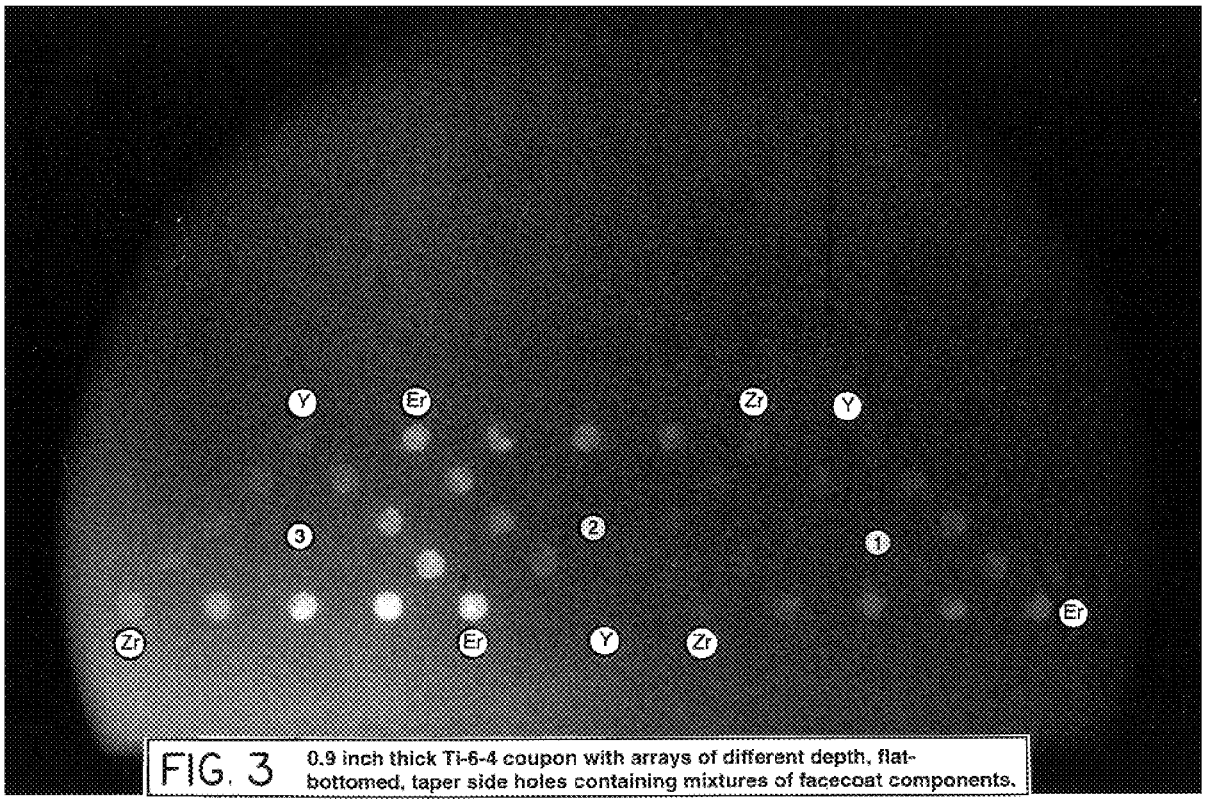
FIG. 3 0.9 inch thick Ti-6-4 coupon with arrays of different depth, flat-bottomed, taper side holes containing mixtures of facecoat components.

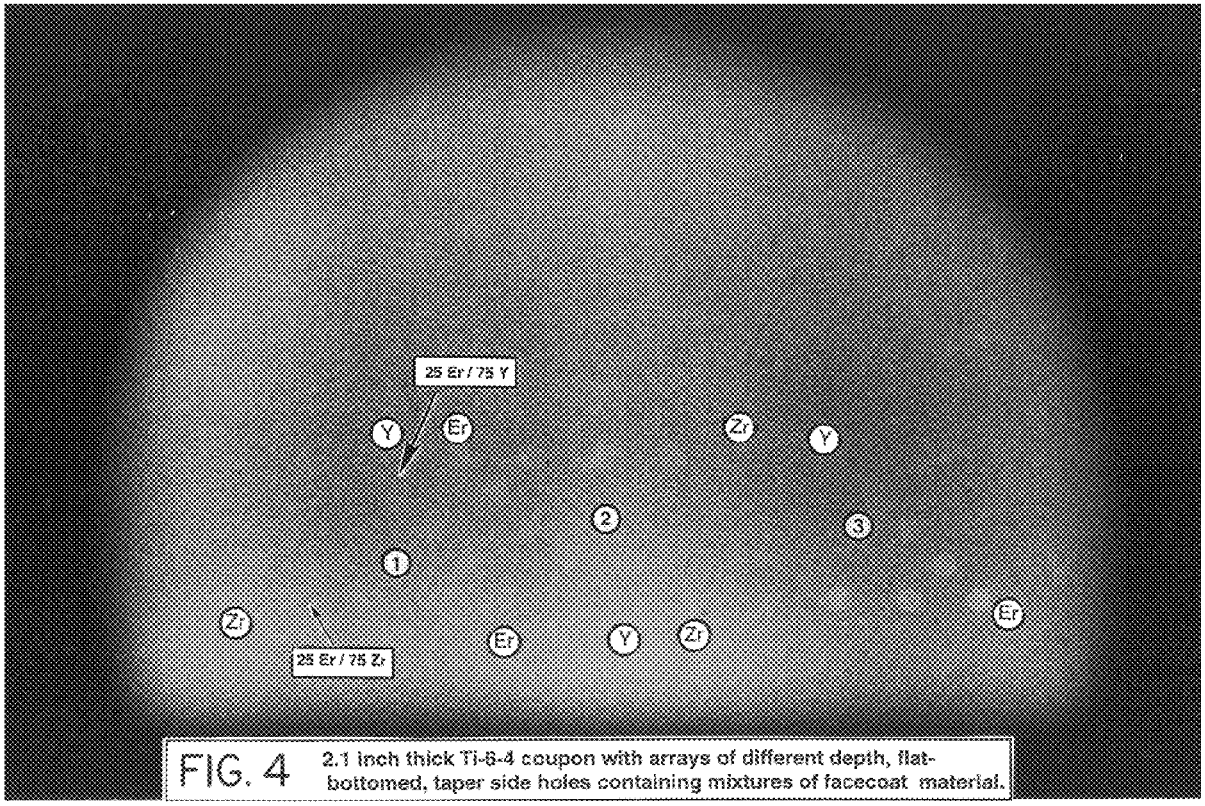
FIG. 4 2.1 inch thick Ti-6-4 coupon with arrays of different depth, flat-bottomed, taper side holes containing mixtures of facecoat material.

METHOD OF CASTING WITH IMPROVED DETECTABILITY OF SUBSURFACE INCLUSIONS

FIELD OF THE INVENTION

The present invention relates to the casting of metals and alloys, especially titanium and its alloys, using ceramic mold facecoats in a manner to provide detectability of any sub-surface ceramic inclusions that may be present on the casting.

BACKGROUND OF THE INVENTION

Investment casting of titanium and titanium alloys and similar reactive metals in ceramic molds is made difficult by the metal's high affinity for elements such oxygen, nitrogen, and carbon. At elevated temperatures, titanium and its alloys can react with the mold facecoat that typically comprises a ceramic oxide. For example, at elevated temperatures during investment casting in a ceramic investment shell mold having a ceramic oxide facecoat, such as zirconia, a titanium alloy such as Ti-6Al-4V will react with the ceramic oxide to form a brittle, oxygen-enriched surface layer, known as alpha case, that adversely affects mechanical properties of the casting and that is removed by a post-casting chemical milling operation as described, for example, in Lassow et al. U.S. Pat. No. 4,703,806.

Moreover, ceramic oxide particles originating from the mold facecoat can become incorporated in the casting below the alpha case layer as sub-surface inclusions by virtue of interaction between the reactive melt and the mold facecoat as well as mechanical spallation of the mold facecoat during the casting operation. The sub-surface oxide inclusions are not visible upon visual inspection of the casting, even after chemical milling.

The manufacture of titanium based structural airframe components by investment casting of titanium and its alloys in ceramic investment shell molds poses problems from the standpoint that the castings should be cast to near net shape so as to require only a chemical milling operation to remove any alpha case present on the casting. However, any sub-surface ceramic inclusions located below the alpha case in the casting are not removed by the chemical milling operation and further are not visible upon visual inspection of the casting. There thus is a need in the art for a method of making such structural airframe components by investment casting of titanium and its alloys in ceramic investment shell molds in a manner that enhances detectability of any sub-surface ceramic inclusions that may be present below exterior surfaces of the casting.

An object of the present invention is to provide a method of making castings, such as for example, structural airframe component castings, by casting titanium and its alloys as well as other metals and alloys in contact with a mold facecoat that satisfies this need by providing for ready detectability of sub-surface ceramic inclusions that may be present below the exterior surface of the casting.

SUMMARY OF THE INVENTION

One aspect of the present invention involves a method of making a cast component by casting of a metal or alloy, especially titanium and its alloys, in a ceramic mold in a manner to provide x-ray, neutron-ray or other non-destructive detectability of any sub-surface ceramic inclusions that may be present below exterior surfaces of the casting. The present invention can be practiced in one embodiment by forming a ceramic shell mold having a facecoat (or other mold layer that may contribute to inclusions in the casting) including erbium bearing ceramic or other X-ray or neutron detectable ceramic material, casting a metal or alloy in the shell mold, removing the solidified casting from the shell mold, and subjecting the solidified casting to x-ray or neutron-ray radiography to detect any sub-surface inclusions below the exterior surface of the casting, which inclusions are not detectable by visual inspection of the casting.

In another embodiment of the present invention, titanium metal or a titanium alloy is cast in contact with a mold facecoat and/or back-up layer including erbium bearing ceramic or other x-ray detectable facecoat component, casting the titanium metal or alloy in the investment shell mold, removing the solidified casting from the mold, chemically milling the casting to remove any alpha case present on the casting, and subjecting the solidified, chemically milled casting to x-ray or neutron-ray radiography to detect any sub-surface ceramic inclusions present below the exterior surface of the casting.

A mold facecoat slurry in accordance with another aspect of the present invention comprises erbium bearing ceramic, preferably fused erbia powder, an optional inorganic binder, and an inorganic pH control agent present in an amount to provide a slurry pH of greater than 10 that is applied to a pattern of a component to be cast to form the mold facecoat. The inorganic pH control agent comprises ammonium or other hydroxide present in an amount to provide a slurry pH of about 10.2 to about 10.4. The slurry may further include one or more other ceramic particulates selected from the group consisting of zirconia, alumina, yttria, and silica particulates in combination with the erbium bearing ceramic particulates. The slurry typically is applied as one or more coatings to a fugitive pattern of the casting in the well known lost wax process for forming a ceramic shell mold.

The present invention is advantageous in that castings can be produced in ceramic investment molds in a manner that provides enhanced detectability of any sub-surface ceramic inclusions proximate and below the surface of the casting not detectable by visual inspection, especially those inclusions that may be located below an alpha case layer of a titanium based casting and that are not removed by a post-cast chemical milling operation. Moreover, since the practice of the invention does not promote further formation of alpha case on titanium based castings, conventional chemcial milling regimes can still be used to remove the alpha case from the casting.

The above objects and advantages of the present invention will become more readily apparent from the following detailed description.

DESCRIPTION OF THE DRAWINGS

FIGS. 2, 3 and 4 are x-ray radiographs of different thickness test coupons having flat bottom holes filled with the simulated mold facecoat ceramic materials.

DETAILED DESCRIPTION OF THE INVENTION

Figure 1:
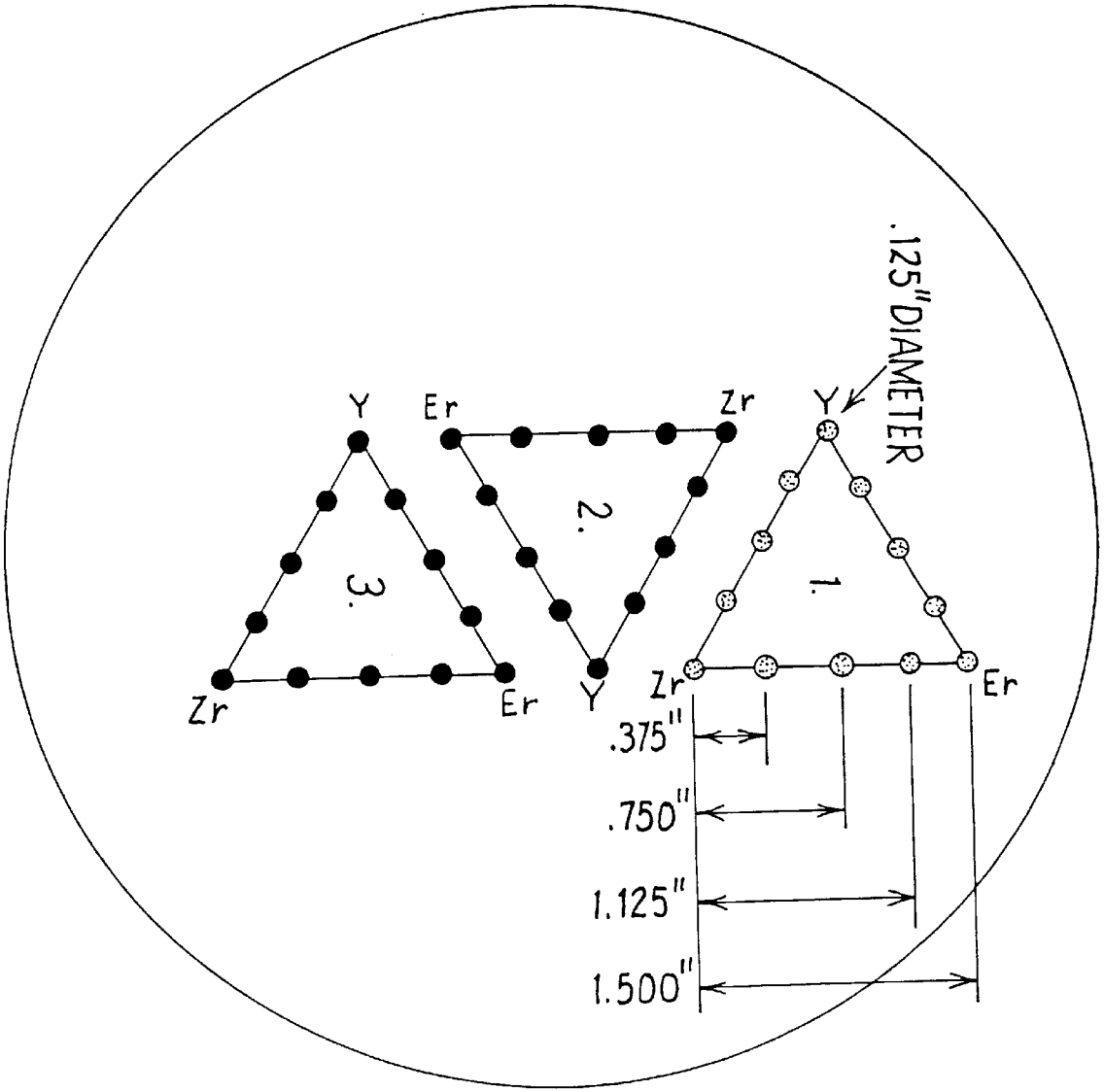
FIG. 1 is a top elevational view of a test coupon used to determine x-ray detectablity of simulated mold facecoat ceramic materials.

The present invention involves in one aspect a ceramic facecoat slurry used in formation of a shell mold that is used in the investment casting of a reactive metal or alloy, especially titanium and its alloys, in a manner to provide enhanced x-ray or neutron-ray detectability of any sub-surface facecoat inclusions that may be present below exterior surfaces of the casting. Other reactive metals or alloys to which it is applicable include, but are not limited to, nickel, cobalt and iron based superalloys, which include reactive alloying elements including hafnium, yttrium and others, zirconium and its alloys, aluminum alloys including reactive alloying elements, and other alloys.

The present invention is especially useful in the manufacture of large titanium based structural airframe cast components by investment casting of titanium and its alloys in ceramic shell molds such that the components can be cast to near net shape and subjected to chemical milling to remove any alpha case followed by ready detection of sub-surface ceramic inclusions below the chemically milled exterior surfaces. Such large titanium based structural airframe cast components typically have a cross-sectional thickness of 1 inch or more, such as 1 inch to 3 inch thickness and more, to 6 inches thickness for example.

In one embodiment of the present invention, the ceramic mold facecoat slurry comprises erbium bearing ceramic particulates and optional other ceramic particulates mixed in an optional inorganic binder and an inorganic pH control agent present in an amount to provide a slurry pH of greater than 10.

The erbium bearing ceramic particulates can be selected from fused, calcined or sintered erbia (erbium oxide) powder and erbium alumina garnet ($Er_3Al_5O_{12}$ atomic formula) in fused form. Fused erbia powder is preferred as the erbia slurry component in that it is more dense and resistant to chemical reaction with a titanium or titanium alloy melt than calcined or sintered erbia powder, although the latter forms of erbia powder are usable in the practice of the present invention. A fused erbia powder particularly useful in practicing the invention is available as Auercoat 4/3 from Treibacher Auermet GmbH, A-9330 Treibach-Althofen, Austria, in the powder particle size of −325 mesh (less than 44 microns). A calcined erbia powder useful in practicing the invention is available as Auercoat 4/4 also from Treibacher Auermet GmbH in the particle size of −325 mesh (less than 44 microns). The mesh size refers to the U.S. Standard Screen System.

In addition to erbium bearing ceramic particulates, the ceramic slurry can include other ceramic particulates such as, for example, selected from one or more alumina, yttria, zirconia, stabilized or partially stablized zirconia, such as calcia partially stabilized zirconia, silica and zircon powder. These other ceramic particulate components of the slurry are used depending upon the particular metal or alloy to be cast. In the case of titianum and its alloys, zirconia powder of particle size −325 mesh is a preferred additional ceramic slurry component because of low cost and low reactivity relative to titanium and titanium alloy melts. Finer or coarser ceramic powders, such as for example only −200 to −400 mesh, can be used in practicing the invention.

When the slurry includes one or more of these additional ceramic particulates, the erbium bearing ceramic particulates preferably are present in an amount from about 10% up to less than 100% by weight of the slurry, and even more preferably between 15 to 60 weight % of the slurry. A 50/50 by weight $Er_2O_3/Zr_2O_3$ slurry is preferred in casting titanium alloys.

An optional inorganic binder preferably comprises colloidal silica available as Ludox HS-30 colloidal silica from DuPont. The colloidal silica binder, when present, provides high temperature binding of the erbium bearing particles as well as any other cermaic particle components of the fired mold facecoat. Other binders that may be used in the practice of the invention include ethyl silicate and others known to those skilled in the art. The erbium bearing particles and other ceramic particle components may be selected to be self sintering such that a binder is not required.

A small amount of deionized water is present in the slurry to adjust slurry viscosity typically within 15–50 seconds, preferably, 20–25 seconds, for the dip coat as determined by the Zahn #4 cup viscosity measurement technique. The amount of water present in the slurry is limited so as not to diminish the green or fired strength of the shell mold.

The inorganic pH control agent included in the slurry preferably comprises reagent grade ammonium hydroxide present in an amount to provide a slurry pH of greater than 10, and more preferably between about 10.2 to about 10.4. The ammonium hydroxide pH control agent is present in the slurry with colloidal silica to control the slurry pH within the above values to prevent gelling of the slurry to provide extended pot life.

The ceramic facecoat slurry also may include other advantageous components such as includng, but not limited to, latex for mold facecoat green strength, a viscosity control agent, a surfactant, an anti-foam agent, starches, gums, and nucleating agent for fine grain as illustrated in the exemplary ceramic facecoat slurries below.

The following four exemplary ceramic facecoat slurries pursuant to the invention are offered for purposes of illustrating useful slurries and not for purposes of limitation.

In these examples, Ludox HS-30 is a collodial silica available from DuPont, Wilmington, Del. LATEX is a styrene butadiene latex for mold green strength available from Reichhold, Research Triangle Park, N.C. AMMONIUM ALGINATE is a commercially available viscosity control agent.

DI $H_2O$ is deionized water. "1410" is an antifoam agent available from Dow Corning, Midland, Mich. MINFOAM 1X is a surfactant available from Union Carbide Corporation, Danbury, Conn. $NH_4OH$ is reagent grade concentrated ammonium hydroxide.

ZIRCONIA "Q" and ZIRCONIA "I" are zirconia powders of −325 mesh available from Norton Company, Worcestor, Mass. The CALCINED ERBIA is erbia powder of −325 mesh available from the aforementioned Treibacher Auermet GmbH. The FUSED ERBIA is erbia powder of −325 mesh also available from Treibacher Auermet GmbH.

ERIBIA FACECOAT INGREDIENTS

| Ingredient | Amount (gm) |
|---|---|
| 1 | |
| CALCINED ERBIA + ZIRCONIA "Q" SLURRY | |
| HS-30 | 1392 |
| LATEX | 91 |
| AMONIUM ALGINATE | 135 |
| DI $H_2O$ | 300 |
| MINFOAM 1X | 11 |
| 1410 | 5 |
| $NH_4OH$ | 25 |
| CALCINED ERBIA | 4100 |
| ZIRCONIA "Q" | 4100 |
| 2 | |
| CALCINED ERBIA + ZIRCONIA "I" SLURRY | |

-continued

| ERIBIA FACECOAT INGREDIENTS | |
|---|---|
| Ingredient | Amount (gm) |
| HS-30 | 1392 |
| LATEX | 91 |
| AMONIUM ALGINATE | 135 |
| DI $H_2O$ | 300 |
| MINFOAM 1X | 11 |
| 1410 | 5 |
| $NH_4OH$ | 25 |
| CALCINED ERBIA | 4100 |
| ZIRCONIA "I" | 4100 |

| 3 FUSED ERBIA + ZIRCONIA "Q" SLURRY | |
|---|---|
| HS-30 | 1392 |
| LATEX | 91 |
| AMONIUM ALGINATE | 135 |
| DI $H_2O$ | 300 |
| MINFOAM 1X | 11 |
| 1410 | 5 |
| $NH_4OH$ | 25 |
| FUSED ERBIA | 6750 |
| ZIRCONIA "Q" | 6750 |

| 4 FUSED ERBIA + ZIRCONIA "I" SLURRY | |
|---|---|
| HS-30 | 1392 |
| LATEX | 91 |
| AMONIUM ALGINATE | 135 |
| DI $H_2O$ | 300 |
| MINFOAM 1X | 11 |
| 1410 | 5 |
| $NH_4OH$ | 25 |
| FUSED ERBIA | 6750 |
| ZIRCONIA "I" | 6750 |

The ceramic facecoat slurry is made by mixing the aforementioned slurry components in any convenient manner using conventional mixing equipment, such as a propeller mixer. The order of mixing of the facecoat ingredients is in the order that they are listed above. Viscosity of the facecoat slurry is adjusted by adding the liquids or ceramic powders listed above.

The ceramic facecoat slurry typically is applied as one or more coatings to a fugitive pattern, such as a wax pattern, having a configuration corresponding to that of the casting to be made pursuant to the well known lost wax process. For example, a pattern made of wax, plastic, or other suitable removable material having the desired configuration (taking into account an overall shrinkage factor) is formed by conventional wax or plastic die injection techniques and then is dipped in the aforementioned ceramic mold facecoat slurry. The slurry also may be applied to the pattern by flow coating, spraying or pouring. In the event that the mold facecoat will comprise two dipcoats or layers, the pattern may again be dipped in the ceramic facecoat slurry and partially dried and/or cured.

The partially dried and/or cured single layer (or multiple layer) facecoat then is covered with relatively coarse ceramic stucco followed by mold backup layers comprising alternating ceramic slurry dipcoats and ceramic stucco until a desired shell mold thickness is built up on the pattern. A shell mold for casting titanium and its alloys can include the aforementioned ceramic facecoat covered with alumina stucco having a particle size range of 100 to 120 mesh and then alternating backup dipcoats/stucco layers comprising zircon based dipcoats (e.g. a zircon based backup slurry comprising zircon, colloidal silica binder, and other conventional components) and ceramic stucco comprising alumina or alumina silicate and having a stucco particle size range of 14 to 28 mesh to build up to a total shell mold thickness in the range of 0.25 to 1.0 inch.

One or more of the mold back-up layers may also include an x-ray detectable erbium bearing ceramic component as well in order to help detect inclusions in the solidified casting that may have originated from the back-up layer(s), for example, by cracking of the shell mold during the mold firing and/or casting operation. The back-up layer(s) would contain enough of the x-ray detectable ceramic component to enhance detection of such inclusions during x-ray or neutron ray radiography or other non-destructive testing.

The shell mold formed on the pattern is allowed to dry thoroughly to remove water and form a so-called green shell mold. The fugitive pattern then is selectively removed from the green mold by melting, dissolution, ignition or other known pattern removal technique. For casting titanium and its alloys, the green mold then is fired at a temperature above 1200 degrees F., preferaby 1400 to 2100 degrees F., for time period in excess of 1 hour, preferably 2 to 4 hours, to develop mold strength for casting. The atmosphere of firing typically is ambient air, although inert gas or a reducing gas atmosphere can be used.

Prior to casting a molten metal or alloy, the shell mold typically is preheated to a mold casting temperature dependent on the particular metal or alloy to be cast. For example, in casting of titanium and its alloys, the mold is preheated to a temperature in the range of 600 to 1200 degrees F. The molten metal or alloy is cast into the mold using conventinal techniques which can include gravity, countergravity, pressure, centrifugal, and other casting techniques known to those skilled in the art using conventional casting atmospheres which include vacuum, air, inert gas or other atmospheres. Titanium and its alloys are generally cast under relative vacuum in order to avoid reactions with oxygen in ambient air as is well known. After the solidified metal or alloy casting is cooled typically to room temperature, it is removed from the mold and finished using conventional techniques adopted for the partcular metal or alloy cast. For example, for a titanium or titanium alloy casting, the solidified casting is subjected to a chemical milling operation to remove any alpha case present on the casting exterior surface.

In accordance with an aspect of the present invention, the solidified casting is subjected to x-ray radiography after finishing to detect any sub-surface ceramic inclusion particles at any location within the casting not detectable by visual inspection of the exterior surface of the casting. For example, for a titanium or titanium alloy casting, the solidified casting is subjected to a chemical milling operation to remove any alpha case present on the casting exterior surface, the depth of the alpha case being dependent upon the thickness (i.e. section size) of the casting as is known. The chemically milled casting then is subjected to x-ray radiography to detect any sub-surface ceramic inclusions residing below the chemcially milled exterior surface of the casting.

The ceramic inclusions commonly originate from the shell mold facecoat by virtue of reaction between the reactive molten metal and the mold facecoat and/or mechanical spallation or cracking of the mold facecoat and/or mold back-up layers during the casting operation. For titanium and titanium alloy castings, the ceramic inclusion particles may be present below the alpha case of the casting surface as sub-surface inclusions. After the chemical milling operation, the ceramic inclusion particles can be present below the chemically milled exterior surface as random sized sub-surface inclusions at random locations and random depths. The sub-surface ceramic oxide inclusions are not visible upon visual inspection of the chemically milled casting as a result.

The casting is subjected to x-ray radiography using conventional x-ray equipment to provide an x-ray radiograph that then is inspected or analyzed to determine if any sub-surface inclusions are present within the casting.

Since sub-surface ceramic oxide inclusions often originate from the mold facecoat, facecoat-containing inclusions are x-ray detectable by virtue of the particular ceramic mold facecoat used pursuant to the invention. In particular, the mold facecoat as described hereabove comprises an erbium bearing ceramic (or other x-ray detectable ceramic) alone or with one or more other ceramic materials. The erbium bearing ceramic is preferred for the facecoat for making titanium and titanium alloy castings since erbium exhibits a greater x-ray density than that of other ceramic components that typically might be present as well as that of titanium or alloyants present in the casting and also exhibits acceptable resistance to reaction with molten titanium and titanium alloys during the casting operation.

Alternately or in addition to x-ray radiography, the solidified casting can be subjected to other non-destructive testing embodying, for example, conventional neutron-ray radiography. The solidified casting may be subjected to neutron activation involving neutron radiation of the casting effective to form radioactive isotopes of the erbium of the mold facecoat ceramic component that may be detectable by conventional radioactive detecting devices to count any erbium isotopes present.

The present invention can be practiced using mold facecoats other than the erbium bearing ceramic mold facecoat described in detail hereabove. For example, a mold facecoat slurry that includes other x-ray detectable slurry components can be used. For example, other ceramic facecoat slurries that can be used include the following x-ray detectable slurry components: $WO_2$, $ThO_2$, $HfO_2$, $UO_2$, and $Yb_2O_3$. As mentioned above, the erbium bearing ceramic slurries described in detail above are preferred as a result of the relatively high x-ray detectability of erbium compared to other elements and high resistance of erbia to reaction with molten titanium and titanium alloys during casting not displayed by other high x-ray density ceramic materials. The erbium bearing facecoat moreover is not radioactive compared to $ThO_2$ and other radioactive ceramic bearing facecoats and thus is advantageous to this end.

The following examples are offered for purposes of illustration and not limitation:

Test coupons comprising commercially available Ti-6Al-4V titanium alloy were fabricated as shown in FIG. 1 to include triangular arrays or patterns "1.", "2.", and "3." of flat bottom cylindrical holes (diameter of 0.125 inch) with different hole depths. For example, pattern "1." had a hole depth of 0.005 inch, pattern "2." had a hole depth of 0.010 inch, and pattern "3." a hole depth of 0.020 inch. Spacings (in inch dimensions) between holes are shown in FIG. 1. The test coupons had different thicknesses of 0.25, 0.90 and 2.1 inch thickness.

Various mixtures of facecoat ceramic powders were blended. The mixtures as well as erbia powder alone, zirconia powder alone, and yttria powder alone were filled into the holes and packed into the holes as now described. In particular, the holes of each of the triangular arrays or patterns were filled with dry ceramic powders or mixtures thereof simulating ceramic facecoat materials wherein the hole at each corner was filled with 100 weight % of the ceramic powder (−325 mesh) indicated as 100% erbia powder for the hole designated "Er", 100% zirconia powder for the hole desginated "Zr", and 100% yttria powder for the hole designated "Y". Mixtures of these ceramic powders were filled in the intervening holes around the triangular pattern starting with a 75/25 mixture immediately adjacent the corner hole, then a 50/50 mixture, and then a 25/75 mixture. For example, between the "Er" corner hole and the "Zr" corner hole, the first hole adjacent the "Er" corner hole included 75% erbia powder/25% zirconia powder, the next intermediate hole included 50% erbia powder/50% zirconia powder, and the last hole adjacent the "Zr" corner hole included 25% erbia powder/75% zirconia powder.

The x-ray parameters approximated standard production prameters for the thickness of Ti-6Al-4V coupons used and are listed below:

| coupon thickness | film | time of exposure | kilovolts |
|---|---|---|---|
| 0.25 inch | D3 | 2 minutes | 125 |
| 0.90 inch | D5 | 2 minutes | 200 |
| 2.1 inches | D7 | 2 minutes | 250 |

Results of the x-ray detectability tests are shown in FIGS. 2 through 4 where the 100% erbium filler powder and erbium bearing ceramic filler mixtures were much more x-ray detectable than the other simulated facecoat ceramic materials; namely, zirconia alone, yttria alone or mixtures thereof with one another, even using the non-optimized x-ray parameters set forth above. In particular, even the 0.005 inch deep holes filled with 25% erbia/75% yttria powder mixtures and 25% erbia/75% zirconia powder mixtures were readily detectable on the x-ray radiograph on the 2.1 inch thickness Ti-6Al-4V test coupon whose radiograph is shown in FIG. 4. In contrast, the 0.005 inch deep holes filled with zirconia, yttria and mixtures are not as readily detectable.

When sub-surface ceramic inclusions are found from the x-ray radiograph of a particular casting, the casting may be subjected to grinding and weld repair operations to remove and replace sufficient material to remove the objectionable inclusions, or the casting may be scrapped if the inclusion(s) is/are too large and/or extend to a depth requiring excessive removal of material from the casting.

Although the invention has been described herebaove with respect to certain embodiments and aspects, those skilled in the art will appreciate that the invention is not limited to the particular embodiments and aspects described herein. Various changes and modifications may be made thereto without departing from the spirit and scope of the invention as set forth in the appended claims.

We claim:

1. A method of making a casting wherein one or more sub-surface ceramic inclusions may be present below an exterior surface of the casting and not detectable by visual inspection of the casting, comprising forming one of a mold facecoat and mold back-up layer from which said inclusions can originate and reside at random location and depth in said casting to include an erbium bearing ceramic component having x-ray or neutron-ray detectability, casting the metal or alloy in said mold, removing the solidified casting from contact with said mold, and subjecting the solidified casting to non-destructive testing including one of x-ray radiography and neutron-ray radiography to provide a radiograph, and determining from said radiograph if any said subsurface ceramic inclusions are present below the exterior surface of the casting.

2. The method of claim 1 including forming a mold facecoat to include the erbium bearing ceramic and pH control agent.

3. The method of claim 1 wherein the erbium bearing ceramic comprises erbia present in an amount from about 10 to 100 weight % of ceramic components present in the mold facecoat.

4. The method of claim 1 wherein the erbium bearing ceramic comprises fused erbia.

5. A method of making a titanium or titanium alloy casting wherein one or more sub-surface ceramic inclusions may be present below an exterior surface of the casting and not detectable by visual inspection of the casting, comprising forming one of a mold facecoat and mold back-up layer from which said inclusions can originate and reside at random location and depth in said casting to include an erbium bearing ceramic having high x-ray or neutron-ray detectability, casting the titanium or titanium alloy in contact with said mold facecoat, removing the solidified casting from contact with said mold, chemically milling the casting to remove alpha case and subjecting the solidified casting to x-ray radiography or neutron-ray radiography to provide a radiograph, and determining from said radiograph if any said sub-surface ceramic inclusions are present below the exterior surface of the casting.

6. The method of claim 5 including providing erbia in one of a mold facecoat and mold back-up layer as the erbium bearing ceramic.

7. The method of claim 6 wherein erbia is present in an amount from about 10 to 100 weight % of the facecoat.

8. The method of claim 6 including providing fused erbia in the mold facecoat.

9. A method of making a titanium or titanium alloy structural airframe component casting wherein one or more sub-surface ceramic inclusions may be present below an exterior surface of the casting and not detectable by visual inspection of the casting, comprising forming a mold having a shape corresponding generally to said component including forming one of a mold facecoat and mold back-up layer from which said inclusions can originate and reside at random location and depth in said casting to include an erbium bearing ceramic having high x-ray or neutron-ray detectability, casting the titanium or titanium alloy in said mold, removing the solidified casting from contact with said mold, chemically milling the casting to remove alpha case and subjecting the solidified casting to x-ray radiography or neutron-ray radiography to provide a radiograph, and determining from said radiograph if any said sub-surface ceramic inclusions are present below the exterior surface of the casting.

10. The method of claim 9 including providing erbia in one of a mold facecoat and mold back-up layer as the erbium bearing ceramic.

11. The method of claim 10 wherein erbia is present in an amount from about 10 to 100 weight % of the facecoat.

12. The method of claim 9 wherein said casting has a cross sectional thickness of 1 inch to 6 inches.

13. A method of making a casting wherein one or more sub-surface ceramic inclusions may be present below an exterior surface of the casting and not detectable by visual inspection of the casting, comprising forming one of a mold facecoat and mold back-up layer from which said inclusions can orignate and reside at random location and depth in said casting to include an erbium bearing ceramic component, casting the metal or alloy in said mold, removing the solidified casting from contact with said mold, and subjecting the solidified casting to non-destructive testing including irradiating the casting to form a radioactive isotope of erbium, and detecting if any said sub-surface ceramic inclusions originating from said mold facecoat or back-up layer are present below the exterior surface of the casting by detecting for said isotope.

* * * * *